United States Patent [19]

Nance

[11] 4,059,980

[45] Nov. 29, 1977

[54] METHOD AND MEANS FOR INSTALLING BLIND FASTENERS

[75] Inventor: Frank B. Nance, Los Alamitos, Calif.

[73] Assignee: Olympic Fastening Systems, Inc., Middletown, Ohio

[21] Appl. No.: 632,394

[22] Filed: Nov. 17, 1975

[51] Int. Cl.[2] ..... B21J 15/34

[52] U.S. Cl. ..... 72/391

[58] Field of Search ..... 72/391; 29/243.53, 243.54

[56] References Cited

U.S. PATENT DOCUMENTS

| | | | |
|---|---|---|---|
| 2,999,610 | 9/1961 | Gapp | 72/391 |
| 3,157,305 | 11/1964 | Baugh | 72/391 |
| 3,698,231 | 10/1972 | Davis | 72/391 |

*Primary Examiner*—Victor A. DiPalma
*Assistant Examiner*—Gene P. Crosby
*Attorney, Agent, or Firm*—Melville, Strasser, Foster & Hoffman

[57] ABSTRACT

The method and means for installing blind fasteners involves a pulling head design such that will cause the stem of the rivet pin to be broken at a predetermined location by a trimming or notching action of the head. This allows a previously unweakened blind fastener pin to be weakened for breaking at a prescribed location after the fastener is installed, thus accomplishing a pin break off substantially flush with the head of the fastener over an extremely wide range of thickness and types of materials being fastened. The pulling means may include a support housing which slidably receives a chuck assembly for pulling the blind rivet pin. A collet is also mounted in the support housing. The collet has suitable cutting edges for weakening the pin stem immediately adjacent the head of the rivet sleeve when appropriate load forces are reached. Cooperating cam surfaces on the support housing and collet react to the load forces to effect this weakening action. The means for controlling the load forces to effect such stem weakening may be mechanical, mechanical with spring adjustment, or mechanical/hydraulic with adjustment.

7 Claims, 12 Drawing Figures

METHOD AND MEANS FOR INSTALLING BLIND FASTENERS

BACKGROUND OF THE INVENTION

1. Field of the Invention

This invention relates to rivets, particularly to the pull-type blind rivets, and a method and means for installing them.

Blind rivets in general find useful application in the riveting of lapped workpieces where access may be conviently had by a worker to one side only. In the trade, the accessible side of the work is often referred to as the "top side" and the opposite side as the "blind side", and for convience these terms are used herein.

Most pull-type blind rivets include two basic parts, namely, a sleeve having a shank and a radially enlarged head, and a pin having a pulling section and a stem, the stem having a head to engage that end of the sleeve remote from the sleeve head. When assembled prior to use, the stem of the pin is received within the sleeve with its pulling section projecting therefrom beyond the rivet sleeve head and with the pin head engaging the sleeve end. Setting of the rivet, as suggested by the class designation, is achieved by pulling the pin head against the end of the sleeve outwardly away from the top side of the work.

In conventional use, an assembled pull type blind rivet is inserted from the top side into substantially aligned apertures in the workpieces. The head of the sleeve is positioned flush with the top side of the work, causing the shank to project on the blind side. An outward pulling force is then applied to the projecting pulling section of the pin and a reactive or restraining force is applied to the head of the sleeve via the head of the pin in order to set the rivet. This causes the portion of the rivet sleeve shank projecting on the blind side to be radially expanded or "upset" progressively to clinch or clamp the workpieces together. As will be understood, when the rivet is fully set, the workpieces are clamped between the sleeve head on the top side and the radially expanded portion of the shank, or blind head as it is known in the art, on the blind side.

2. Description of the Prior Art

In order to leave a final riveted connection, which is relatively flush with the exposed top side of the work, without having to trim the pin in a separate operation, it has heretofore been conventional in the art to provide a pin with a weakened section termed a "breakneck" groove. A number of these had to be provided in order to take care of workpieces having varying thickness. After the shank is upset in the manner described above, resistance to pin travel, and thus tension in the pin, increases under the continued application of the pulling force. The pin, in prior arrangements, was designed to fracture at the appropriate breakneck groove when this tension reaced a predetermined level, whereupon the pulling section of the pin separated from the portion disposed within the sleeve.

It is apparent from the above that in these prior practices it was necessary to cause the stem to be weakened (the provision of the breakneck groove) prior to assembly with the sleeve. United States Patent No. 3,230,818 discloses much of the prior art concept and practice discussed above. A search of the United States patent art was conducted in connection with this invention and a number of references were developed as listed below. No assertion is made, however, that the best patent art was developed although that indeed was the intent of the search. The developed references are: U.S. Pat. Nos. 2,384,037 — KUGLER, 2,438,201 — BUCHET, 2,457,417 — TRAUTMANN, 2,999,610 — GAPP, 3,017,052 — KOLEC, 3,055,528 — SEIFERT, 3,122,948 — BAUGH, et al., 3,157,305 — BAUGH, 3,196,662 — SIMMONS, 3,230,818 — SIEBOL, 3,638,472 — ORLOFF, et al., 3,667,340 — BLACK, et al., 3,698,231 — DAVIS, JR., Italian Pat. No. 371,817 — MUSSO.

Of the foregoing patents, the following are generally illustrative of a practice which has long been employed in the art to eliminate excess pin stem, namely, providing some sort of "break-neck" which will rupture when a certain pulling pressure has been reached: U.S. Pat. Nos. 2,384,037; 3,017,052; 3,055,528; 3,122,948; 3,157,305; and 3,196,662. (U.S. Pat. Nos. 3,638,472 and 3,667,340 appear to be of general interest only).

Siebol Patent 3,230,818, earlier discussed, is of importance in that although it does not disclose a means for clipping off or trimming the pin stem, it does disclose a means which causes a crown provided on the outside of the sleeve head to be "buckled" into aligned grooves on the pin stem, see FIGS. 6, 7 and 9. Siebol, however, relied on break-neck grooves for removing the excess pin stem.

Buchet U.S. Pat. No. 2,438,201 discloses means for shearing off the surplus mandrel, note particularly column 2, lines 22 to 30 and column 3, lines 24 to 32.

Trautmann U.S. Pat. No. 2,457,417 refers to the invention as comprising a "stem trimmer". The specifics for accomplishing this, however, differ considerably.

Gapp U.S. Pat. No. 2,999,610 also seems to contemplate some form of "pin trimming", see particularly column 1, lines 57 to 62; column 4, lines 62 to 73; and column 5, lines 1 to 8.

Davis U.S. Pat. No. 3,698,231 also refers to the severing of a lock bolt at a point adjacent the collar by what appears to be a combined swedging and cutting action.

SUMMARY OF THE INVENTION

Prior art practice called for the pin stem to be weakened, provided with a break-neck, prior to assembly with the sleeve. The instant invention provides a method and means for causing the pin stem to break without the stem having been previously weakened. This is achieved by a mechanical trim action resulting entirely from fastener installation loads. This new development allows, in effect, an infinite location of the eventual stem break point within the design range of the fastener, thus eliminating the need for rolling the pin stem to produce a weakness, or from providing such weakness by other means. Specifically the invention allows a previously unweakened blind fastener pin to be weakened at a prescribed location after the fastener is installed whereby to achieve a pin break off flush with the head of the fastener over a wide range of material thickness fastened.

DESCRIPTION OF THE PREFERRED EMBODIMENTS

Figure 1:
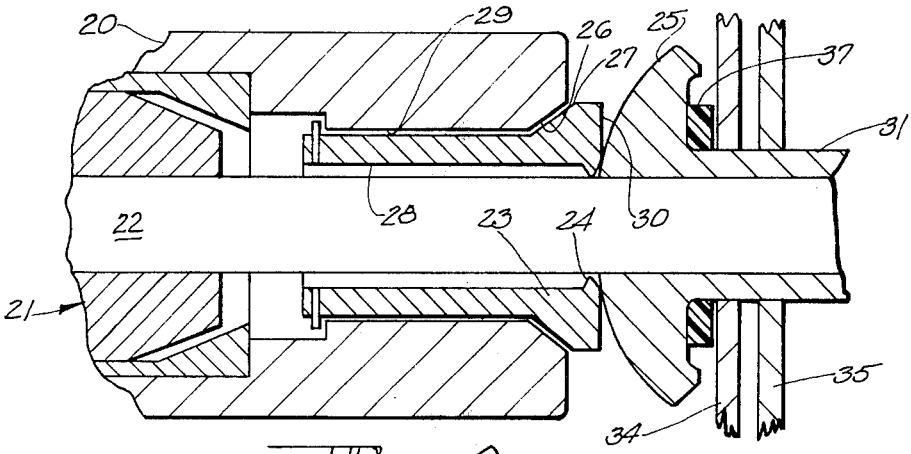
FIG. 1 is a fragmentary sectional view depicting installation of a blind fastener and portions of the fastener, workpieces and exemplary tool.
Figure 2:
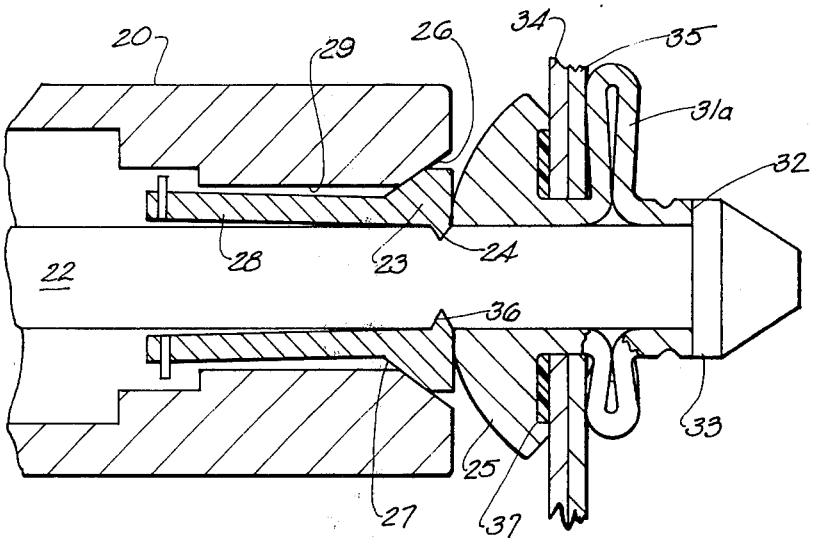
FIG. 2 is a fragmentary sectional view similar to FIG. 1 but depicting the positions of the various elements when required fastener installation loads have been reached.

Referring now particularly to FIGS. 1 and 2, one embodiment of the invention is illustrated. This embodiment comprises a support housing 20 and a chuck assembly generally indicated at 21 for pulling the pin 22. Reference is again made to Siebol U.S. Pat. No. 3,230,818 wherein a typical pulling mechanism is illustrated and described.

Figure 6:
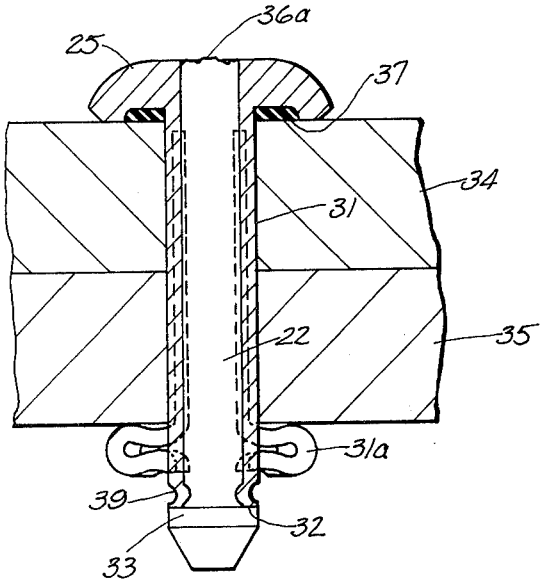
FIG. 6 is a view similar to FIG. 5 but illustrating the finished, clamped condition of the workpieces after the blind fastener has been set and the excess stem removed.
Figure 7:
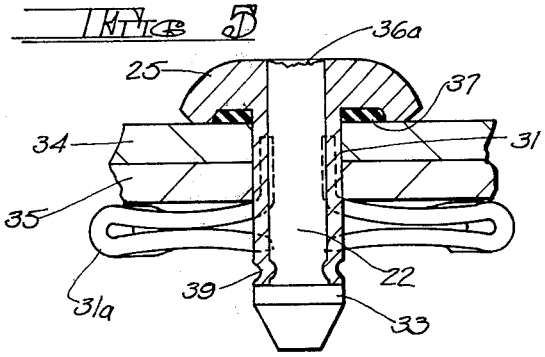
FIG. 7 is a view similar to FIG. 6 but showing the blind fastener as having been installed to clamp together a pair of thinner workpieces.

The chief difference between the mechanisms illustrated in FIGS. 1 and 2 of this invention, as compared to FIGS. 6 and 7 of U.S. Pat. No. 3,230,818, is in the specific nature of the split collet 23 as compared to the collet 84 of the patent. Collet 23 of the instant invention, which collet may be formed in separate segments, or in one piece slotted to define such segments, is provided with a cutting edge 24 which will eventually form a notch or weakened area in the pin stem 22 adjacent the rivet head 25 whereby to form a break-neck in situ.

The support housing 20 is provided with a cam surface 26 and the segments of the split collet 23 are provided with cam surfaces 27. The split collet segments 23 have sleeve-like portions 28 extending within the bore 29 provided in the support housing 10; these segments 23 also have a forward abutment surface 30 which will engage the head 25 of the rivet sleeve 31. It will be understood that the end 32 of the sleeve 31, this end being removed from the sleeve head 25, is engaged by the head 33 of the rivet pin 22, this being common practice in blind fastener construction. In the arrangement of this invention, however, no break-necks or other weakened areas are imparted to the rivet pin stem prior to its installation in the workpieces 34 and 35 to be fastened.

Figure 3:
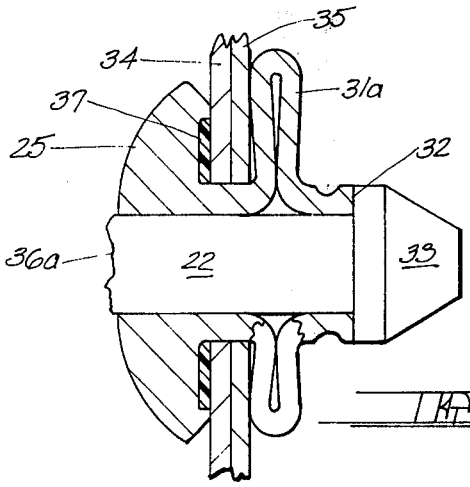
FIG. 3 is a fragmentary sectional view of the workpieces as joined by the blind fastener in its finished, clipped-off condition.

Contraction of the split collet segments 23, whether they be separate or part of an integral unit, to bite into the rivet pin stem 22 as indicated at 36 so as to form a notch or weakened area therein by virtue of the cutting edges 24, all during the cutting operation, is achieved by virtue of the mating frusto-conical surfaces 26 and 27 on the support housing 20 and collet segments 23 respectively. Because of thse surfaces, the collet segments 23 are caused to contract as they are forced into the bore 29 in the forward portion of the support housing 20. Such movement may be yieldably resisted by appropriate spring action (not specifically shown in these figures), or by other means such as, for example, building resistance into the collet 23 itself, particularly when it comprises an integral unit slotted to form the movable segments, and when the axial force is sufficient to overcome the spring action or other resistance, the collet segments 23 assume the position oF FIG. 2. (Reference is again made to U.S. Pat. No. 3,230,818 for a full description of this general type of pull action.) Further acutation of the chuck assembly 21 for pulling the pin 22 will cause the stem to break in the region of the notch 36 as indicated at 36*a* in FIG. 3 which illustrates the completed installation of the blind fastener to join the members 34 and 35. During the setting of the blind fastener, the rivet sleeve 31 is caused to buckle as indicated at 31*a* to secure the workpieces 34 and 35 between such buckled portion and the underside of the head 25; a washer 37 is often inserted beneath the head 25 as indicated although this washer is not always necessary and may sometimes be omitted.

Figure 4:
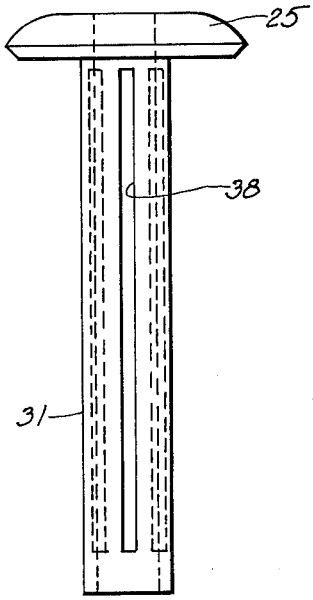
FIG. 4 is an elevation of a blind rivet sleeve suitable for use in this invention.
Figure 5:
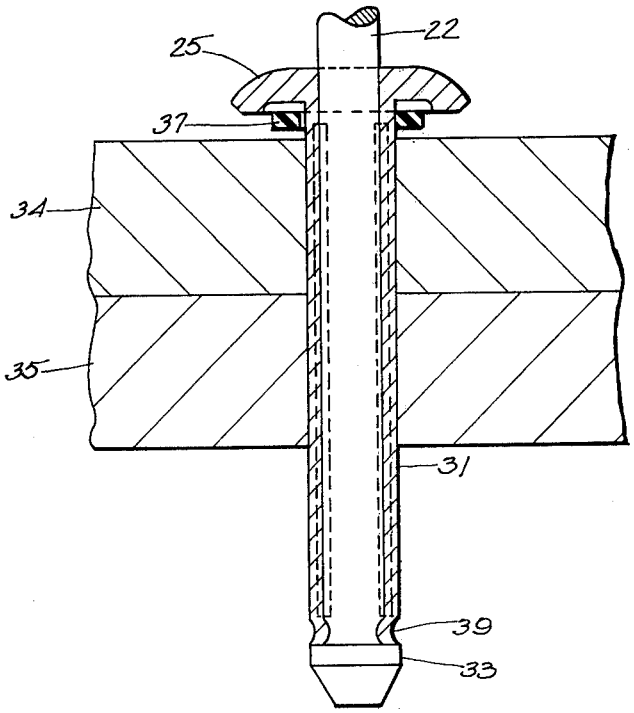
FIG. 5 is a fragmentary sectional view showing the blind fastener prior to having been set to fasten a pair of relatively thick workpieces.

Advantages of this invention are illustrated in FIGS. 4 through 7. FIG. 4 depicts that portion of a blind fastener comprised of a rivet sleeve 31 having a head 25 integral therewith. This sleeve is preferably provided with a plurality of longitudinal slots 38. The other portion of the blind fastener is shown in FIG. 5 as comprised of the rivet pin stem 22 having a head 33 integral therewith. In this invention the stem 22 is uninterrupted throughout its length. In assembled condition, however, the sleeve 31 may be staked to the pin 22 as indicated at 39 so that these portions of the blind fastener are firmly secured together.

The rivet sleeve 25, 31 and rivet pin 22, 33 may be made of a standard length, it being understood that the pin 22 will extend beyond the rivet sleeve head 25 a sufficient distance to enable it to be properly grasped by a suitable chuck assembly 21 for pulling this pin. As previously stated the pin stem 22 is uninterrupted when assembled with the rivet sleeve; no "break-necks" are provided. The advantage of this arrangement is that standard blind fasteners may be used to join workpieces of an extremely wide range of thickness. Thus, in FIG. 7 the workpieces 34 and 35 are shown of relatively quite thin thickness. Nevertheless the pieces may be joined by the method and means of this invention by blind fasteners which are alike. In both the conditions illustrated in FIGS. 6 and 7 the blind fastener is initially inserted in the manner illustrated in FIG. 5 and a pulling action on the stem 22 is exerted as described in connection with FIGS. 1 and 2. When a predetermined load condition is reached, as set by a suitable spring or other means as will be described further, the fastener sleeve is bulbed as at 31*a* to clamp the workpieces 34 and 35 between such bulb and the underside of the head 25 whereafter a further pulling force will actuate the split collet segments 23 and their cutting edges 24 to enable the pin to be broken substantially flush with the head 25 as indicated at 36*a*. This will take place regardless of whether the materials are relatively thick as indicated in FIG. 6 or relatively thin as indicated in FIG. 7. The only real difference is that the bulb area 31*a* in the arrangement oF FIG. 7 will be considerably larger than the bulb area 31*a* in FIG. 6. In both cases, however, the workpieces 34 and 35 are securely fastened.

Figure 8:
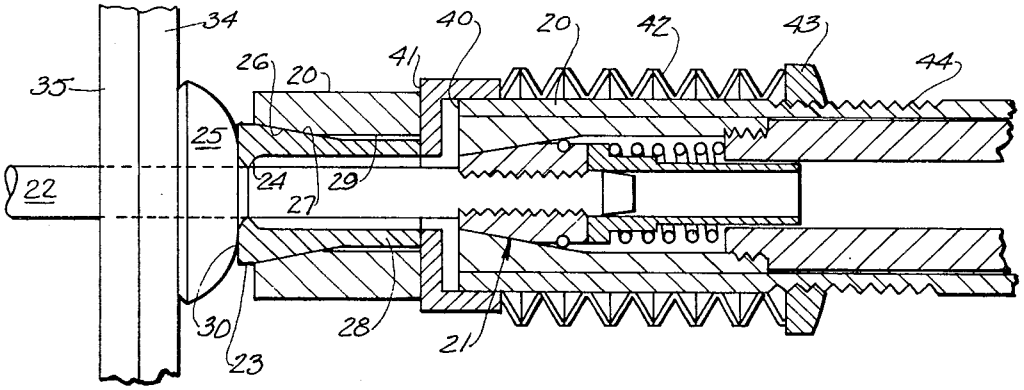
FIG. 8 is a fragmentary sectional view, partly schematic, generally similar to that of FIG. 1 but depicting a modification of the means for installing a blind fastener.

Further illustrations of the method and means for installing the blind fastener of FIGS. 4 and 5 are depicted in FIGS. 8 through 12. In FIG. 8 the support housing 20 is shown as provided with a slot 40 to receive a member 41 which is L-shaped in cross section. The slot 40 is appreciably wider than that portion of the member 41 which extends therewithin. The chuck assembly for grasping the tail-end of the pin 22 so that it may be pulled to set the blind fastener is again indicated at 21. The collet segments 23 are again shown as being provided with cutting edges 24 and a head portion 30 to abut the head 25 of the rivet sleeve. The sleeve portions 28 of the collet segments 23 abut the L-shaped member 41.

A control spring 42 is positioned around the support housing 20 and is contained between the L-shaped element 41 and an adjusting nut 43 threadely secured to the housing 20 as indicated at 44. In operation the blind fastener is installed through the workpieces 34 and 35 and the support housing 20 and collet 23 are positioned so that the head portion 30 of the collet 23 is against the head 25 of the rivet sleeve; the chuck assembly 21 will engage the tail end of the pin 22. A pulling force is then exerted so that the chuck assembly moves within the support housing 20, such movement being to the right as viewed in FIG. 8. This will exert a pulling force on the blind fastener sufficient to upset the sleeve 31 to form the bulb 31*a*. The control spring 42 is of such strength as to prevent movement of the L-shaped member 41 in the slot 40 until the blind fastener has been upset. At point of upset, however, the forces are such that the spring 42 will be overcome and the collet segments 23 will be drawn within the support assembly 20 as the L-shaped element 41 moves within the slot 40 against the resitance of the spring 42 whereby the cutting edges 24 of the collet segments 23 will be forced into the pin stem 22 to form the notch 36, whereafter further pulling forces will cause the stem to break at this point 36. This biting action is also occasioned by the coaction of the cam surfaces 26 and 27. The effective resistance force of the spring 42 may be adjusted by properly positioning the nut 43 as will be understood by those skilled in the art.

Figure 9:
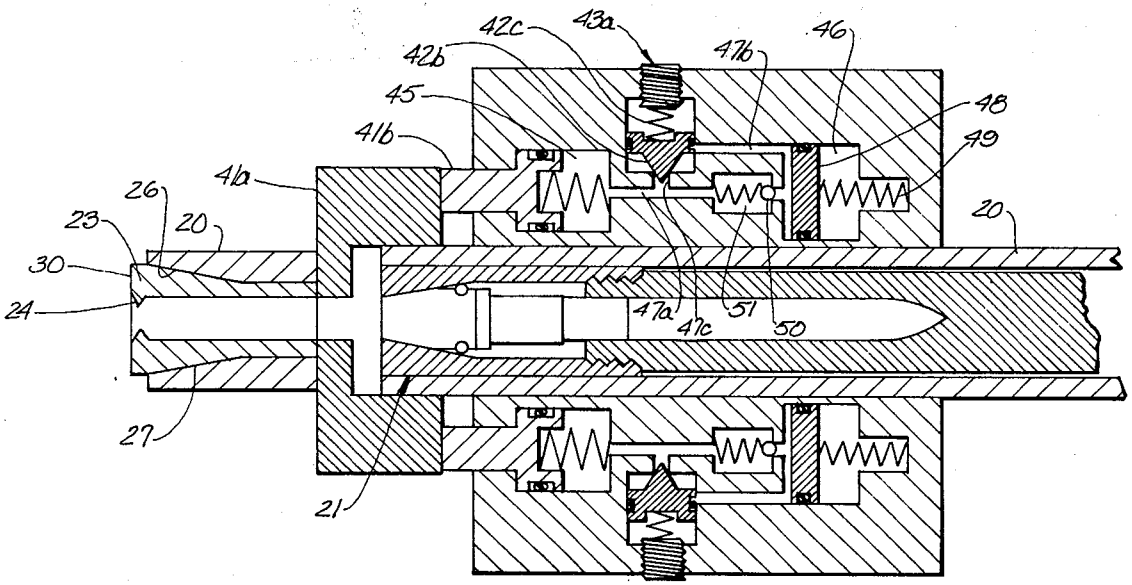
FIG. 9 is a fragmentary sectional view, partly schematic, showing a further modification of the means for installing a blind fastener.

In the arrangement of FIG. 9 the control 42*a* is assisted by an hydraulic system comprised of the chambers 45 and 46 connected by a passageway 47*a*, 47*b* interrupted by the port 47*c* and valve member 42*b* which is spring biased as indicated at 42*c*. The chamber-passage system is filled with a supply of suitable fluid from a source not shown.

The support housing 20 is again provided with a slot 40 which receives the member 41*a*. When the blind fastener is installed in the workpieces to be fastened, the head 30 of the collet 23 will again be brought into contact with the head of the rivet sleeve and a pulling force effected on the stem 22 via the chuck assembly 21.

As the chuck assembly 21 moves within the support housing 20 to the right as viewed in FIG. 9, the blind fastener will be upset to join the workpieces 34 and 35 between the bulb 31*a* and underside of the rivet sleeve head 25 as before, movement of the collet 23 and member 41*a* being prevented by reason of the fluid within the chamber 45 and the valve 42*b* blocking the port 47*c* extending into the passage 47*a* which communicates with the chamber 45. The setting 43*a*, 42*c* will be such as to prevent movement of the valve member 42*b* out of the port 47*c* until such time as the blind fastener is set. At that time the forces will be such as to move the valve 42*b* out of the port 47*c* whereafter fluid in the chamber 45 may flow through the passage 47*a*, port 47*c* and passage 47*b* to the chamber 46. Further pulling force exerted on the chuck assembly 21 will thus permit the member 41*a* to move within the slot 40 against the piston member 41*b* in the chamber 45 so that the collet 23 will be drawn within the support housing 20 and, by virtue of the cam surfaces 26 and 27, the cutting edges 24 will be caused to bite into the rivet pin stem 22 to form a notch or place of weakening so that a further pulling effort will cause the stem to break substantially flush with the outside of the rivet sleeve head 25 as indicated at 36*a* in the various figures.

It will be understood by those skilled in the art that when the forces are such as to upset the blind fastener and then actuate the collet segments 23 as just described, the fluid entering chamber 46 will force the piston member 48 to the right as viewed in FIG. 9. When the pulling forces are released, the spring 49 will be of sufficient strength to move the piston member 48 to the left, as viewed in FIG. 9, to reset the system by moving the fluid past the spring biased detent 50 and through the chamber 51 and passageway 47*a* back to the chamber 45; release of the pulling forces will permit the control means 43*a*, 42*c* to force the valve member 42*b* to that position wherein it closes the port 47*c* leading to the passage 47*a*, piston 41*b* and member 41*a* then returning to the reset position of FIG. 9.

Figure 10:
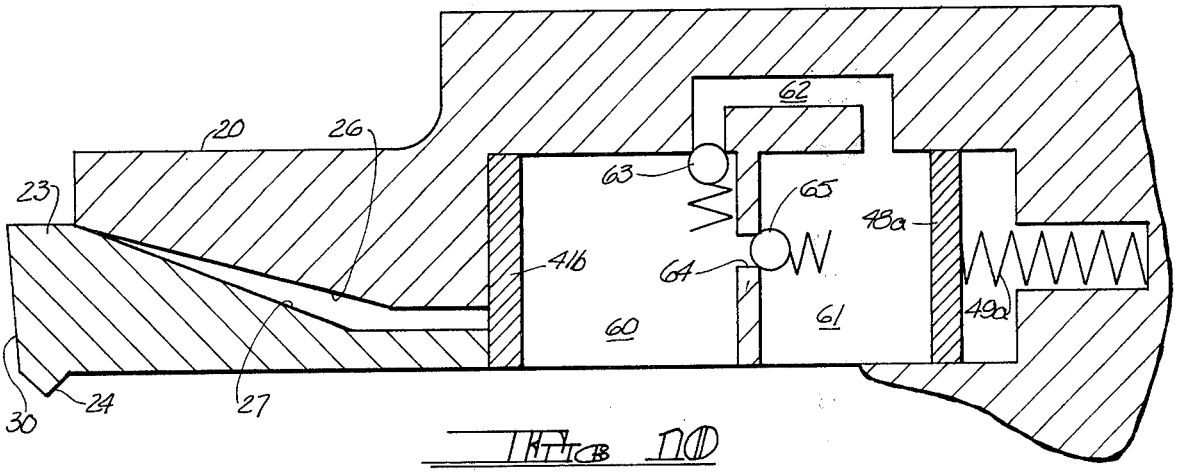
FIGS. 10, 11 and 12 are fragmentary sectional views, partly schematic, depicting yet another arrangement for installing a blind fastener, the figures depicting, respectively, the relative position of the parts prior to actuating the clipping means, while actuating the clipping means, and immediately after release of the pulling pressure exerted when installing the fastener.
Figure 11:
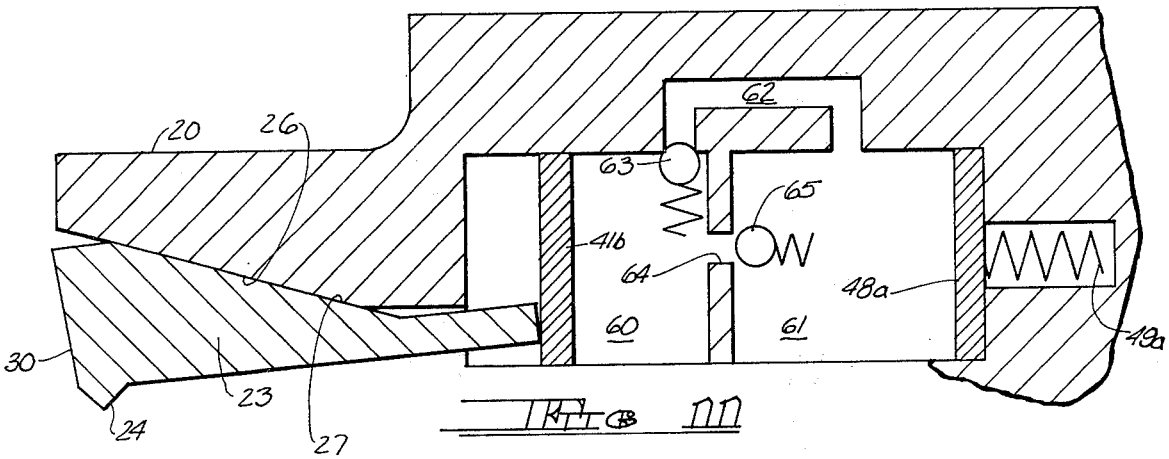
Figure 12:
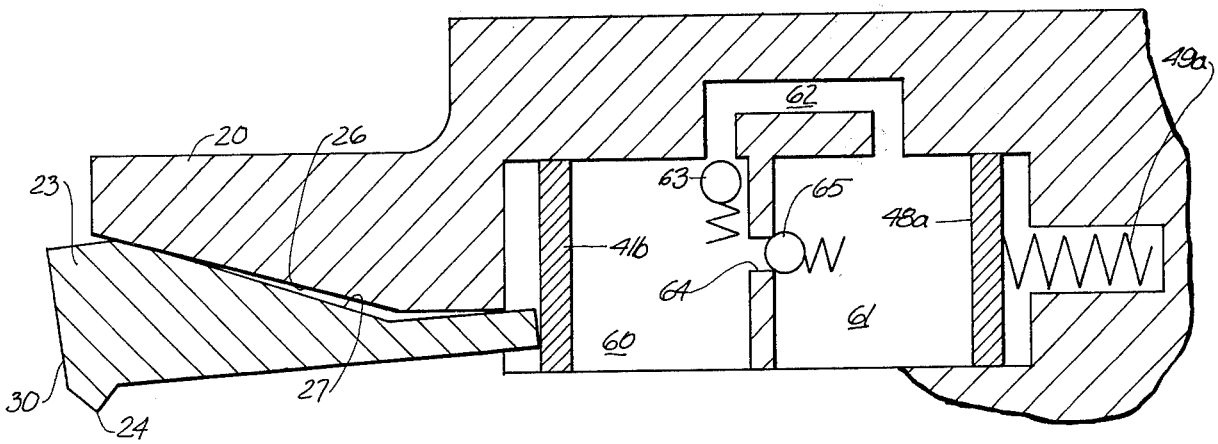

The hydraulic arrangement of FIGS. 10, 11 and 12 is generally similar to that described in connection with FIG. 9 and, therefore, like parts have, as has been done throughout, been given like reference numerals. The arrangement includes a pair of chambers 60 and 61 joined by a passageway 62 controlled by a spring biased valve 63; there is also a port 64 between these chambers which is controlled by a spring biased valve 65. A piston-like member 41*b* is movable within the chamber 60 and a piston-like member 48*a*, spring biased as at 49*a*, is movable within the chamber 61.

When the portion 30 of the collet 23 is initially placed against the head 25 of the rivet sleeve, and before any pulling forces are exerted by the chuck assembly (not shown in these figures), the various parts will be in the positions indicated in FIG. 10. To this end it will be understood that the pressure within chamber 60 will be greater than the pressure within the chamber 62 and the outside pressure exerted on the member 65 will be greater than the pressure within the chamber 60. These pressures will be such as to permit the blind fastener to be upset to clamp the workpieces 34 and 35 before movement of the collet 23 within the support housing 20 is permitted. After blind fastener upset pressures have been reached, continued pulling effort will bring the parts to the positions indicated in FIG. 11 at which time the pressure in chamber 60 will be greater than the outside pressure exerted on the member 65 whereupon fluid will be forced through the port 64 into the chamber 61 to move the piston-member 48*a* against the spring 49*a*, the collet 23 and piston-member 41*b* moving to the right as indicated in these figures, whereby the cutting edge 24 of the collet 23 again, by virtue of the cam surfaces 26 and 27, bites into the rivet pin stem 22 to permit it to be broken away substantially flush with the outside of the rivet sleeve head 25 as indicated at 36*a* in various of the figures.

FIG. 12 simply illustrates movement of the parts to the reset position as will occur when pulling pressures are released. In this situation the pressure within chamber 61 is greater than the pressure within chamber 60 and the outside pressure on 65 is greater than the pressure within chamber 60 whereby to close the port 64 and open the passage 62 so that fluid may flow from the chamber 61 into the chamber 60 to begin movement of the parts to the full reset position shown in FIG. 10.

Trimming of the pull stem as described and explained above may be further amplified as follows, particularly when hydraulic means are utilized as in the arrangements of FIGS. 9 through 12. A high stand-off pressure, pressure to resist closing or actuation of the collet 23, is desired during actual installation and setting of the fastener. Once such fastener installation and setting have been achieved, as much of the accumulated pressures as possible should be shunted or diverted (dumped-off) to aid in effecting the trimming of the stem. Thus pressures are in effect built up and held to a given load and then released for trimming. This is more true of the hydraulic systems wherein an initially high stand-off pressure is attained at the out-set than of the spring systems shown wherein there is a more gradual build up of spring pressure. (Those skilled in the art, however, will recognize that there are also spring systems, such as those utilizing split resilient bands, not shown, and the like which will also give an initially high stand-off pressure). More specifically, when the initially high pressure in the front chamber 45 of the FIG. 9 arrangement, for example, pops off as fluid passes to the rear chamber 46, the effect is to transfer such pressure to closing the collet 23 as it then moves within housing 20 to cause the cutting edge 24 to bite into the stem.

It will be understood by those skilled in the art that the particular type or style of blind fastener depicted in the drawings, particularly in FIGS. 1 through 7, is not the only type or style of blind fastener which lends itself to the instant invention. That shown is certainly a prime example but other blind fasteners may be employed. The invention is readily adaptable to the setting of any blind fastener which includes some sort of stem which is to be severed. The invention is, therefore, particularly suited for, and applicable to, stem trimming relative to other fasteners, especially where a flush break of the stem throughout the grip range is desired. By virtue of this invention, precisely located break necks and the like in the pull stem can be eliminated.

It is to be further understood that while this invention has been shown and decribed in terms of certain particular structures and arrangements, the invention is not to be limited to such structures and arrangements except insofar as they are specifically set forth in the subjoined claims. In this regard it will be apparent to those skilled in the art that modifications in the invention may be made without departing from the scope and spirit thereof.

I claim:

1. Setting means for installing a blind fastener comprised of a headed rivet sleeve and a headed pin inserted therewithin, the head of the sleeve being adapted to engage the top side of the work being fastened, the head of the pin engaging the end of the sleeve remote from the sleeve head, the sleeve end and pin head being beyond the blind side of the work, and the pin having a tail extending beyond the sleeve head which means comprises: a support housing; a chuck assembly slidably mounted within said support housing and having means to grasp the tail of said pin; a collet slidably mounted within said support housing and protruding beyond said support housing, said collet having a forward portion to engage a sleeve head; a first cam surface on said support housing and a second cam surface on said collet, said cam surfaces being arranged to engage one another; a cutting edge on said collet adjacent said forward portion; abutment means slidable in said support housing, said collet having a rearward portion to engage said abutment means; and yieldable means cooperating with said abutment means to prevent initial movement of said abutment means and said collet; whereby when the load forces exerted by movement of the chuck assembly are sufficient to upset the blind fastener, continued movement of said chuck assembly will thereafter cause relative movement and engagement between said cam surfaces to move said cutting edge into said pin to weaken same adjacent the sleeve head, further movement of said chuck assembly causing said pin to break where so weakened.

2. The setting means of claim 1 in which said yieldable means comprises a spring engaging said slidable abutment means, and a stop on said support housing in engagement with said spring.

3. The setting means of claim 2 including regulating means for said stop whereby to vary the resistance offered by said spring to movement of said slidable abutment means and said collet.

4. The setting means of claim 1 in which said yieldable means comprises an hydraulic system associated with said slidable abutment means.

5. The setting means of claim 4 including regulating means for said hydraulic system whereby to vary the resistance offered by said hydraulic system to movement of said slidable abutment means and said collet.

6. Setting means for installing a blind fastener comprised of a headed rivet sleeve and a headed pin inserted therewithin; the head of the sleeve being adapted to engage the top side of the work being fastened, the head of the pin engaging the end of the sleeve remote from the sleeve head, the sleeve end and pin head being beyond the blind side of the work, and the pin having a tail extending beyond the sleeve head which means comprises: a support housing; a chuck assembly slidably mounted within said support housing and having means to grasp the tail of said pin; a collet slidably mounted within said support housing and protruding beyond said support housing, said collet having a forward portion to engage a sleeve head; a first cam surface on said support housing and a second cam surface on said collet, said cam surfaces being arranged to engage one another; a cutting edge on said collet adjacent said forward portion; and yieldable means associated with said collet to prevent initial movement of said cutting edge; whereby when the load forces exerted by movement of the chuck assembly are sufficient to upset the blind fastener, continued movement of said chuck assembly will thereafter cause relative movement and engagement between said cam surfaces to move said cutting edge into said pin to weaken same adjacent the sleeve head, further movement of said chuck assembly causing said pin to break where so weakened.

7. A method for installing a blind fastener of the type comprising a headed rivet sleeve and a headed pin inserted there within, the head of the sleeve being adapted to engage the top side of work being fastened, the head of the pin engaging the end of the sleeve remote from the sleeve head, the sleeve end and pin head being beyond the blind side of the work, and the pin having a tail portion extending beyond the sleeve head, which method comprises the steps of:

a. providing a tool comprised of a collet having a cutting edge and means to apply a pulling force on said tail portion of said pin to bulb said rivet sleeve to clamp the work between the bulb and the sleeve head;

b. arranging said collet and cutting edge to weaken said tail portion at said sleeve head;

c. providing yieldable means on said collet to prevent operation of said cutting edge during the clamping of the work between said bulb and said sleeve head, said yieldable means enabling operation of said cutting edge to weaken said tail portion in response to a pulling force on said tail portion greater than is required to bulb said sleeve;

d. initially pulling said tail portion of said pin sufficient only to bulb said rivet sleeve to clamp the work between said bulb and said sleeve head;

e. thereafter further pulling said tail portion to cause said yieldable means to be overcome whereby to enable operation of said cutting edge to weaken said tail portion at said sleeve head; and f. further pulling said tail portion to cause said tail portion to break where so weakened.

* * * * *